US008115148B1

(12) United States Patent
Boardman et al.

(10) Patent No.: US 8,115,148 B1
(45) Date of Patent: Feb. 14, 2012

(54) METHOD FOR TARGETING A PREFERRED OBJECT WITHIN A GROUP OF DECOYS

(75) Inventors: Jonathan Alan Boardman, Mount Laurel, NJ (US); Naresh Raman Patel, Bellmawr, NJ (US); Jeffrey Bruce Boka, Lumberton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 358 days.

(21) Appl. No.: 12/473,032

(22) Filed: May 27, 2009

(51) Int. Cl.

| | |
|---|---|
| ***F41G 7/30*** | (2006.01) |
| ***F41G 7/00*** | (2006.01) |
| *F42B 15/00* | (2006.01) |
| *G01S 13/00* | (2006.01) |

(52) U.S. Cl. ..... 244/3.14; 244/3.1; 244/3.11; 244/3.15; 89/1.11; 342/59; 342/61; 342/62; 342/175; 342/195

(58) Field of Classification Search ..... 89/1.11; 244/3.1–3.19; 342/61–68, 59, 73–75, 80, 342/89, 94, 95, 175, 195, 104–115, 118, 342/146, 147

See application file for complete search history.

(56) References Cited

U.S. PATENT DOCUMENTS

| | | | | |
|---|---|---|---|---|
| 3,378,835 | A * | 4/1968 | Mooney, Jr. et al. | 342/59 |
| 3,378,840 | A * | 4/1968 | Mooney, Jr. | 342/59 |
| 3,412,396 | A * | 11/1968 | Mooney, Jr. | 342/59 |
| 3,448,452 | A * | 6/1969 | Mooney, Jr. | 342/59 |
| 3,724,783 | A * | 4/1973 | Nolan et al. | 244/3.15 |
| 3,982,713 | A * | 9/1976 | Martin | 244/3.1 |
| 4,308,538 | A * | 12/1981 | Albersheim | 342/95 |
| 4,817,495 | A * | 4/1989 | Drobot | 89/1.11 |
| 5,311,189 | A * | 5/1994 | Nagel | 342/95 |
| 5,340,056 | A * | 8/1994 | Guelman et al. | 244/3.16 |
| 5,381,156 | A * | 1/1995 | Bock et al. | 342/66 |
| 5,501,413 | A * | 3/1996 | Kilger et al. | 244/3.15 |
| 5,611,502 | A * | 3/1997 | Edlin et al. | 244/3.16 |
| 5,710,423 | A * | 1/1998 | Biven et al. | 244/3.1 |
| 6,877,691 | B2 * | 4/2005 | DeFlumere et al. | 244/3.16 |
| 7,032,858 | B2 * | 4/2006 | Williams | 244/3.15 |
| 7,236,121 | B2 * | 6/2007 | Caber | 342/62 |
| 7,394,047 | B1 * | 7/2008 | Pedersen | 244/3.1 |
| 7,473,876 | B1 * | 1/2009 | Pedersen et al. | 244/3.1 |
| 7,548,194 | B2 * | 6/2009 | Wood | 89/1.11 |
| 7,552,669 | B1 * | 6/2009 | Denis et al. | 89/1.11 |
| 7,875,837 | B1 * | 1/2011 | Szabo et al. | 244/3.15 |

* cited by examiner

*Primary Examiner* — Bernarr Gregory
(74) *Attorney, Agent, or Firm* — Howard IP Law Group

(57) ABSTRACT

Current targeting approaches involve guiding to a spatially derived guidepoint of a group of objects likely to be the preferred object. This method may not allow the intercepting missile to contain the preferred, or other probable object(s), within its divert capability. The guidepoint is shifted closer to the preferred object using specific energy and angular momentum, constants of orbital motion, which describe properties of an object's trajectory. Guiding to the specific energy derived guidepoint does not offer significant benefit over guiding to the spatially derived guidance point. However, computing the spatial rate of change of specific energy within the plane formed by the guidance objects establishes a vector pointing close to the preferred object. This is the direction to shift the guidepoint in order to contain the preferred object within the interceptor's divert capability.

17 Claims, 10 Drawing Sheets

METHOD FOR TARGETING A PREFERRED OBJECT WITHIN A GROUP OF DECOYS

BACKGROUND OF THE INVENTION

Current threats in the art of hostile ballistic missiles include the deployment of decoys to make it difficult to identify the preferred object (the object targeted for intercept). The decoy objects for the most part travel in a ballistic manner along paths similar to those of the preferred object. The deployment method may result in mutual separation of the decoy objects from each other and from the preferred object, possibly with high speed. The decoy objects may include booster housing (s), ejected shrouds, metal-surfaced balloons inflated after reaching ballistic operation, including large balloons enclosing the preferred object, a booster of boosters, an attitude control module (acm) and various other objects. "Busing" is used with some missiles, whereby a single boost vehicle carries multiple preferred objects, in which case each preferred object may be viewed as being a decoy as to the other preferred object.

Defense against ballistic missiles includes the use of interceptor missiles fitted with explosive warheads or with kinetic kill vehicles. Targeting is accomplished by guiding the interceptor toward the spatially derived guidance point of the group or cluster of ballistic objects, including both the decoy (s) and the preferred object. A determination is made of which of the objects of the cluster is the preferred object, and the guidance system of the interceptor is then activated, and guides the interceptor toward the preferred object. Ideally, the guidance of the interceptor toward a spatially derived guidance point (a point chosen based on the relative geometry between the objects in the group) of the projected group of objects makes it possible for engagement of the preferred object by diversion of the interceptor during a final stage of guidance. That is, the spatially derived guidance point of the projected group is deemed to be the best location from which to divert when the interceptor final guidance is initiated.

Improved targeting is desired.

SUMMARY OF THE INVENTION

A method according to an aspect of the invention is for targeting, with an interceptor, a preferred object from among a plurality of ballistic objects in an associated group of objects. The method comprises the step of sensing a group of potential target objects which includes a preferred object and an associated group of non-preferred objects, to thereby produce position and velocity vectors for each potential target object of the group. From the position and velocity vectors for each potential target object of the group, at least one of specific energy and specific angular momentum is computed for each of the potential target objects, to thereby produce constants of orbital motion. From the constants of orbital motion, the three target objects exhibiting the specific energy or specific angular momentum above a threshold value are identified, to thereby identify a group of three most likely target objects. The threshold value is a user-defined design parameter, chosen so that three of the target objects have specific energy or specific angular momentum above the threshold. The spatially derived guidance point is calculated of the group of three most likely target objects. The spatial rate of change of the constants of orbital motion is calculated, to thereby produce a guidance direction increment. The spatially derived guidance point is combined with the guidance direction increment, to thereby produce a target or guide point. The target or guide point is expected to be closer to the location of the preferred object than is the spatially derived guidance point. The thrust of the interceptor is controlled to guide the interceptor vehicle toward the target or guide point.

In a particular mode of the method, after the step of controlling the thrust of the interceptor toward the target point, a determination is made of which of the potential target objects is the preferred object, and control of the interceptor is transitioned to guidance toward the preferred object.

An engagement system according to an aspect of the invention is for targeting and engaging a preferred object among a group of non-preferred objects. The system comprises at least one sensor (312) for sensing a group of potential target objects (preferred object, acm, B, 315) which includes a preferred object and an associated group of non-preferred objects, to thereby produce position and velocity vectors for each potential target object. The system also comprises a computer arrangement, which may be a single computer or a distributed computer, and which may include modules for performing specific tasks or an integrated software entity for performing multiple specific tasks. The computer includes at least an aspect for computing, from the position and velocity vectors, at least one of specific energy and specific angular momentum for each of the potential target objects, to thereby produce constants of orbital motion. A computer or ranking aspect thereof ranks the constants of orbital motion for each of the potential target objects, and deems the three target objects having values above a threshold (of the one of the specific energy and specific angular momentum) as identifying a group of the three most likely target objects. A computer or spatially derived guidance point aspect thereof calculates the spatially derived guidance point of the group of three most likely target objects, and calculates the spatial rate of change of the constants of orbital motion, to thereby produce a guidance direction increment. A computer or combining aspect thereof combines the spatially derived guidance point with the guidance direction increment, to thereby produce an interceptor vehicle target point which is closer to the location of the preferred object than is the spatially derived guidance point. A controllable thrust controller is coupled to receive the interceptor vehicle target point, and is also coupled to the interceptor vehicle, for controlling the thrust of the interceptor vehicle to guide the interceptor vehicle toward the target point. In a particularly advantageous aspect of the system, a computer or identification aspect thereof is coupled for receiving at least the constants of orbital motion, for determining which of the potential target objects is the preferred object, and for generating a command for a transition from guidance toward the target point to guidance toward the preferred object. A computer or aspect thereof is coupled to the interceptor vehicle and to receive the command for transition from guidance toward the target point to guidance toward the preferred object, and effectuates the transition from guidance toward the target point to guidance toward the preferred object.

DESCRIPTION OF THE INVENTION

The "guide" point toward which the interceptor is guided is chosen so as to contain the preferred object (po) within the divert capability of the interceptor. This can be important because the objects of the ballistic group or cluster may diverge at a rate which does not allow all of them to be contained using the prior-art spatially derived guidance point method. It should be noted that the spatially derived guidance point lies in a plane which contains those three objects of a group having specific energy or specific angular momentum above a threshold value. According to an aspect of the invention, the interceptor aim, guide, or target point before terminal guidance begins is shifted or deviated away from the spatially derived guidance point and toward the preferred object. This allows containment of those objects likely to be the preferred object within the interceptor divert capability. The shifting or deviation of the guide or target point is based on orbital parameters of the objects. The specific orbital parameter which can be used is one of (a) specific energy and (b) specific angular momentum.

It has been found that specific energy derived guidance point is slightly closer to the preferred object than the spatially derived guidance point of the three objects having specific energy or angular momentum above a threshold value. The specific energy gradient within the plane formed by the objects of the group is in the form of a vector. The vector points in a direction close to the preferred object, or in other words points generally "at" or "toward" the preferred object from the spatially derived guidance point. Shifting of the guide point of the interceptor in the direction indicated by the gradient vector tends to allow containment of the preferred object and other probable objects within the divert capability for a longer period of time than when a simple spatially derived guidance point is used. This additional time allows more time in which to perform the sensing and computations to identify the preferred object.

Figure 1:
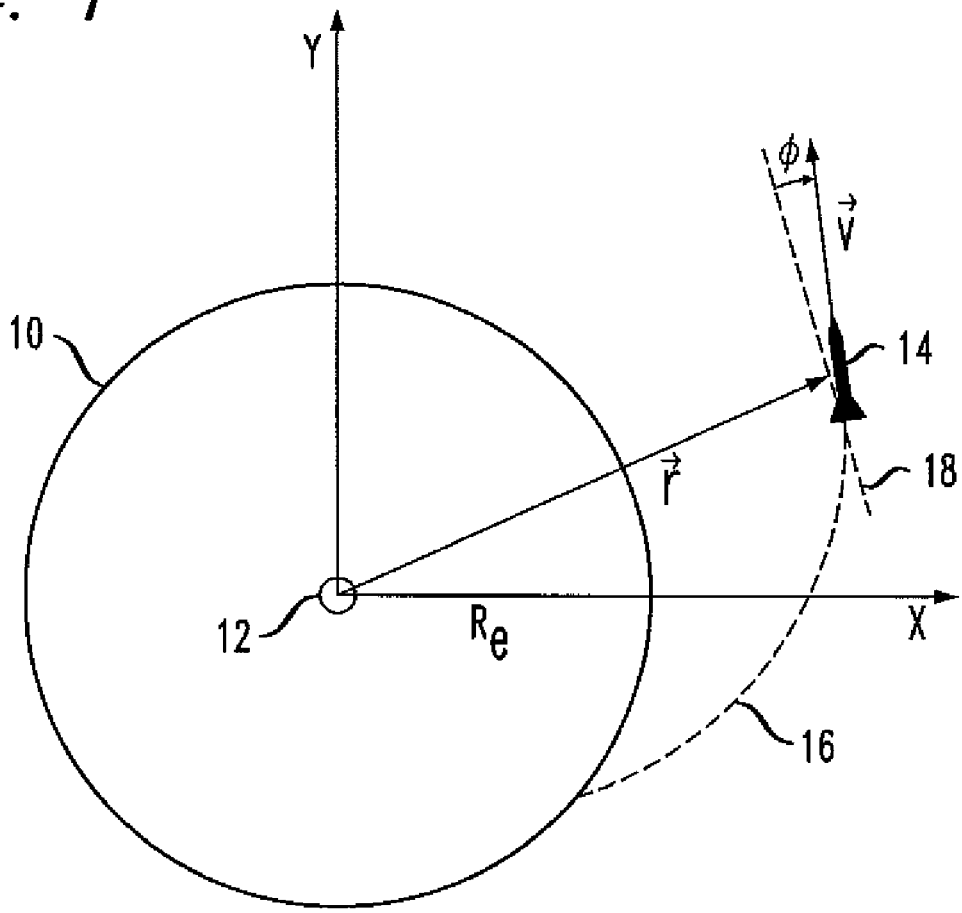
FIG. 1 illustrates an orbit and various vectors to aid in explanation of constants of orbital motion.

FIG. 1 illustrates constants of orbital motion. The constants of orbital motion can be used to differentiate among objects based on their motion. In FIG. 1, the gravitational center 12 of the Earth 10 is centered on X and Y coordinates. The radius $R_e$ of the Earth is indicated. An object, in the form of a hostile missile 14, is illustrated as having followed a boost and ballistic path illustrated by a dash line 16, and currently lies at a radius $\vec{r}$. A local horizon orthogonal to radius $\vec{r}$ $\vec{r}$ is a plane indicated as line 18. The velocity vector of the missile 14 is identified as $\vec{V}$, and is at an angle $\phi$ relative to local horizon 18. The specific energy E of the object 14 of FIG. 1 can be expressed as $$E = \frac{v^2}{2} - \frac{\mu_e}{r} \tag{1}$$

where $\mu_e = 3.986 \times 10^{14}$.

$$\frac{m^3}{s^2}$$

The angular momentum H of the object 14 can be expressed as $$H = |\vec{r} \times \vec{V}| = rV\cos\phi \tag{2}$$

In general, E and H determine the properties of a ballistic trajectory including maximum orbital radius and orbital distance normal to the major axis of the orbital ellipse.

Figure 2A:
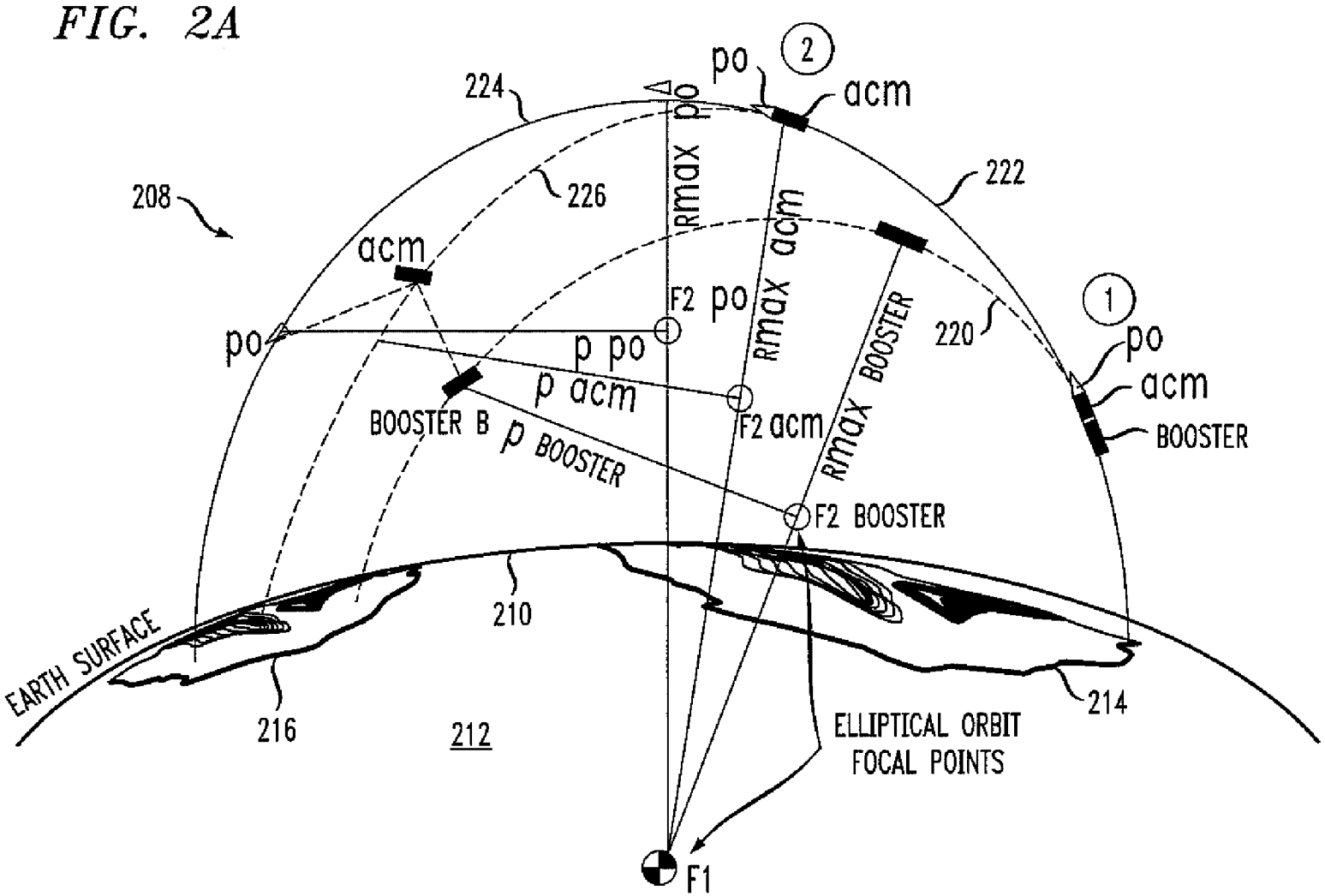
FIG. 2A represents a scenario in which a multipartite hostile missile is launched, illustrating various portions of the orbits of the parts.

FIG. 2A is a simplified representation of trajectories of missile 14, its deployed preferred object po and some "decoy" objects, together defining a group or cluster 208 of objects. Elements of FIG. 2A corresponding to those of FIG. 1 are designated by like alphanumerics. The decoy objects which are illustrated in FIG. 2A are the attitude control module (acm) and the booster B. Group 208 of objects may include other objects, but only the three objects having specific energy or angular momentum above a threshold value are considered. The specific energy of each object is calculated according to equation (1), and the three objects having specific energy (or angular momentum) above a threshold value are considered. Consideration of the three objects having specific energy above a threshold value is accomplished by ranking the values of specific energy of the objects. This method allows for targeting of the object most likely to be the preferred object, but also allows the possibility of targeting another object, which has some probability of being the preferred object. In FIG. 2A, the horizon is illustrated as 210, and a body of water as 212. A first land mass 214 represents the location from which the hostile missile 14 is launched, as suggested by dash line portion 218. The ultimate target of hostile missile 14 is a friendly land mass designated 216. As illustrated at position 1 in FIG. 2A, missile 14 includes a preferred object, an attitude control module acm, and a booster B.

Figure 2B:
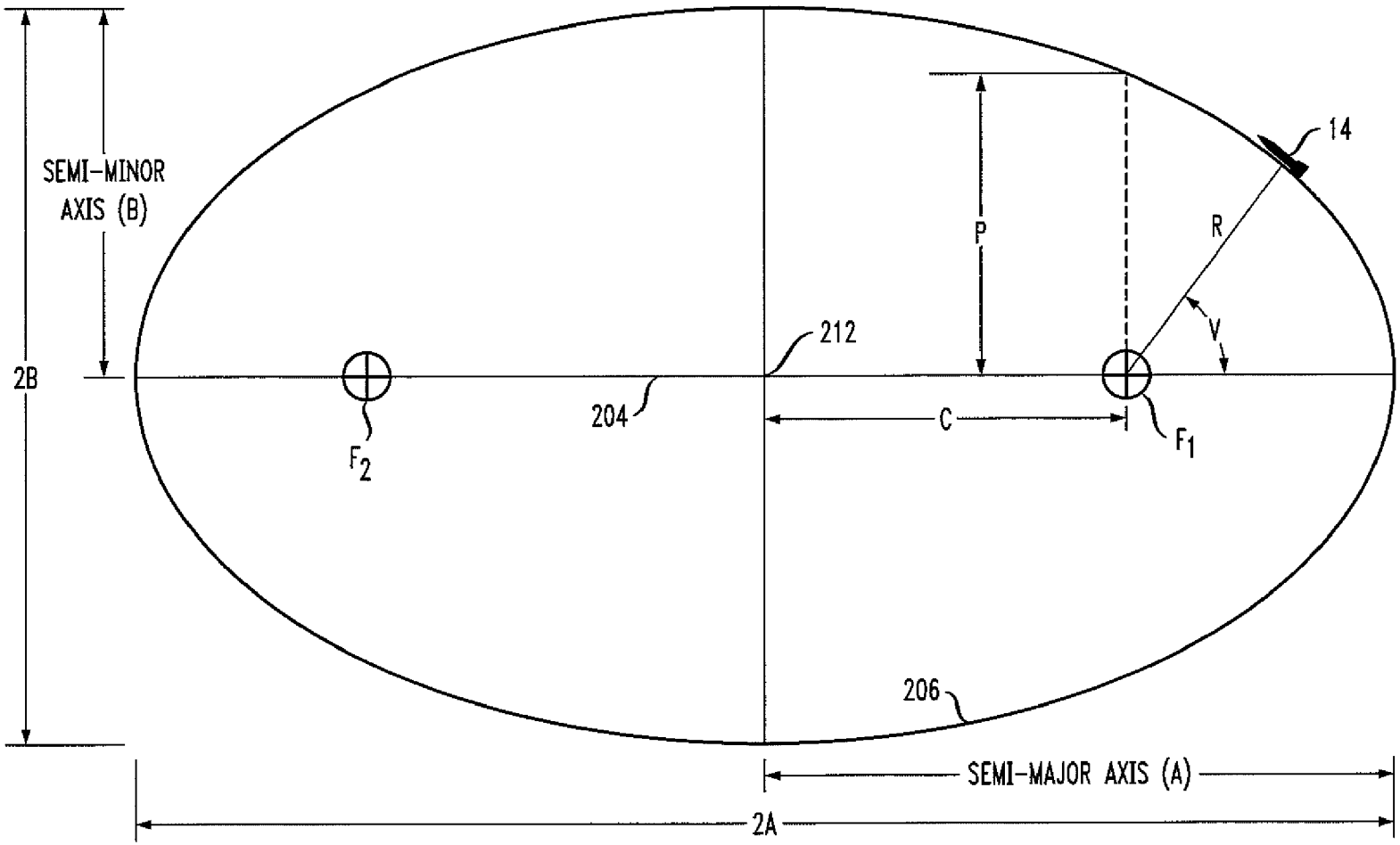
FIG. 2B illustrates an ellipse for defining terms.
Figure 2C:
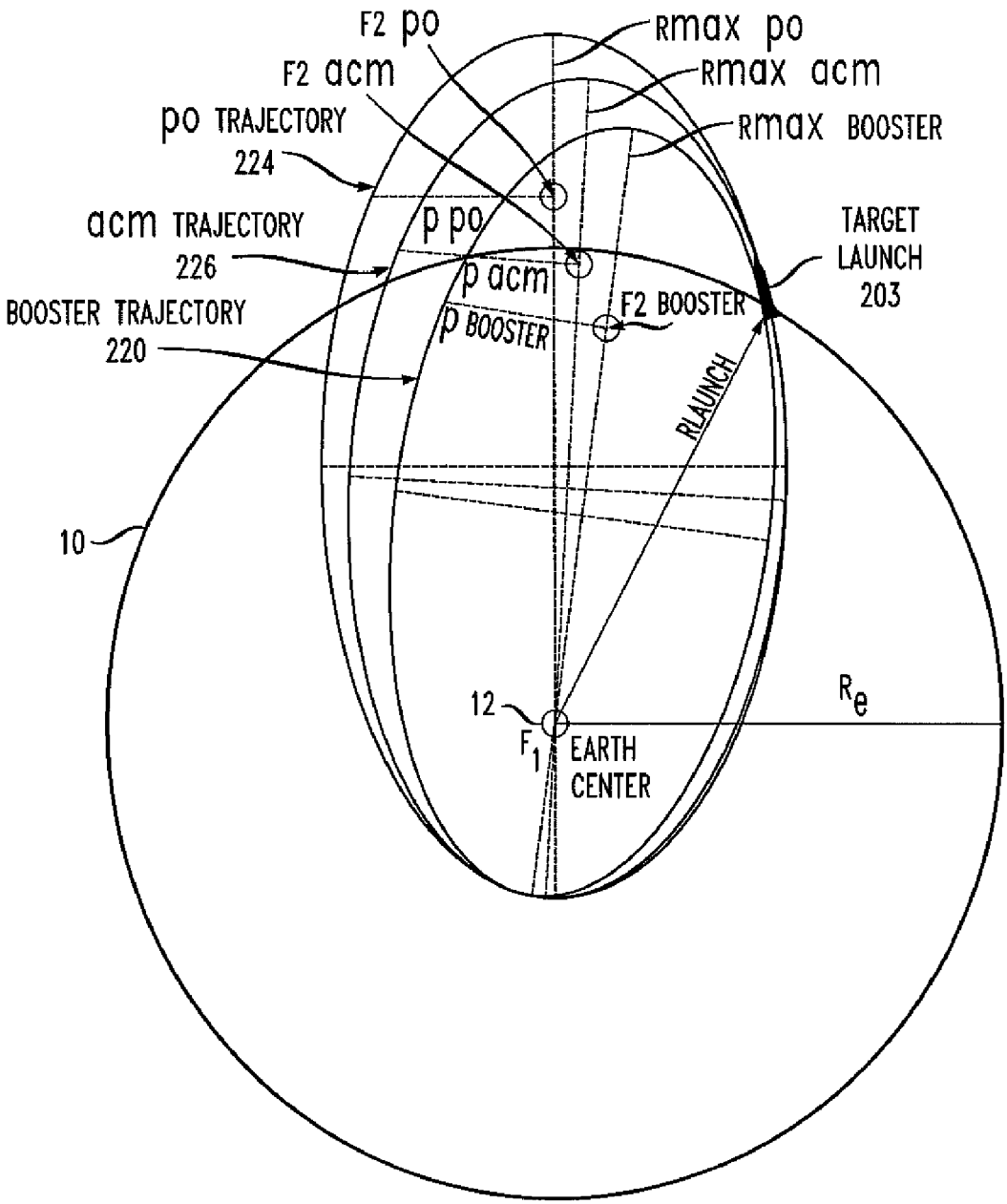
FIG. 2C illustrates the orbital trajectories underlying FIG. 2A.

FIG. 2B illustrates an orbital ellipse 206. In FIG. 2B, $F_1$ and $F_2$ represent first and second focal points lying on the major axis 204 at distance c from the center 212 of the ellipse 206. The semi-major axis is designated a, so the major axis has dimension 2*a*. The semi-minor axis is designated b, so the minor axis has dimension 2*b*. An object 14 is illustrated as orbiting along ellipse 206 at a radius R from $F_1$, which radius makes an angle $\tau$ with the major axis. FIG. 2C represents the orbits of the various objects of FIG. 2A, namely the booster B, the attitude control module (acm), and the preferred object po as superposed on the Earth 10. In FIG. 2C, the Earth's center is designated 12 and also as $F_1$. The booster trajectory is designated 220, the preferred object trajectory is designated 224, and the acm trajectory is designated 226. The hostile missile or target 14 launch point is designated 203. The largest orbital radius from the center of the Earth reached by the booster along trajectory 220 is designated $R_{max}$ booster and is measured from the focal point $F_1$. The largest orbital radius reached by the acm along trajectory 226 is designated $R_{max}$ acm and is also measured from the focal point $F_1$. The largest orbital radius reached by the preferred object po along trajectory 224 is designated $R_{max}$ po and is also measured from the focal point $F_1$.

At a time after launch of missile 14 of FIG. 1, the booster B separates from the preferred object and attitude control module acm, and follows a path illustrated as dash line segment 220 in FIG. 2A, while the conjoined preferred object/acm follows a path suggested by solid-line segment 222. At a position illustrated as 2 in FIG. 2A, the preferred object po separates from the acm. The preferred object follows solid-line segment 224 toward its destination, while the acm follows a dash line segment 226. There may be some atmosphere at ballistic missile orbital altitudes, and the differences between or among the paths of the objects is attributable at least in part to frictional or retarding effects of this atmosphere.

In FIG. 2A, the gravitational center of the Earth 12 is also designated $F_1$, representing the first focus of the elliptical paths taken by the preferred object, the attitude control module acm, and the booster B. The second focus of the elliptical path taken by the booster B is designated $F_2$ booster. The major axis of the orbital ellipse for the booster B lies along the line extending between $F_1$ and $F_2$B. The second focus of the elliptical path taken by attitude control module acm is designated $F_2$ acm, and the major axis of the orbital ellipse for the acm lies along the line extending between $F_1$ and $F_2$ acm. The second focus of the elliptical path taken by the preferred object is designated $F_2$po, and the major axis of the orbital ellipse for the preferred object lies along the line extending between $F_1$ and $F_2$po.

The maximum orbital radius $R_{max}$ of an orbiting object travelling on an elliptical trajectory is given by $$R_M = a(1+\epsilon) \tag{3}$$

where:

a is the semi-major axis of the ellipse; and $\epsilon$ is the eccentricity of the ellipse.

The semi-major axis a of the ellipse is given by $$a = \frac{-\mu_e}{2E} \tag{4}$$

where:

$\mu_e$ is the Earth's gravitational constant (equal to)

$$3.986 \times 10^{14} \frac{\text{Meters}^3}{\text{Second}^2}$$

; and

E is the specific energy.

The eccentricity $\epsilon$ of the ellipse is given by $$\varepsilon = \sqrt{\frac{1 + 2EH^2}{\mu_e^2}} \tag{5}$$

Equation (3), as it applies to FIG. 2A, shows that the maximum orbital radius, or the maximum height above the Earth's surface achieved by an orbiting object depends on the specific energy of the object.

The orbital distance normal to the major axis at second focus $F_2$ of an orbital ellipse is known as the semilatus rectum and is designated p. The semilatus rectum is illustrated in FIG. 2B and represents the distance traveled by the object normal to the major axis of the orbital ellipse. The semilatus rectum of the booster in FIGS. 2A and 2C is designated p booster or pB, the semilatus rectum of the attitude control module in FIGS. 2A and 2C is designated p acm, and the semilatus rectum of the preferred object in FIGS. 2A and 2C is designated p_po. The value of p can be calculated as $$p = \frac{H^2}{\mu_e} \tag{6}$$

where:

H is the specific angular momentum of the object as calculated in Equation (2); and $\mu_e$ is the Earth's gravitational constant as described above.

Figure 3:
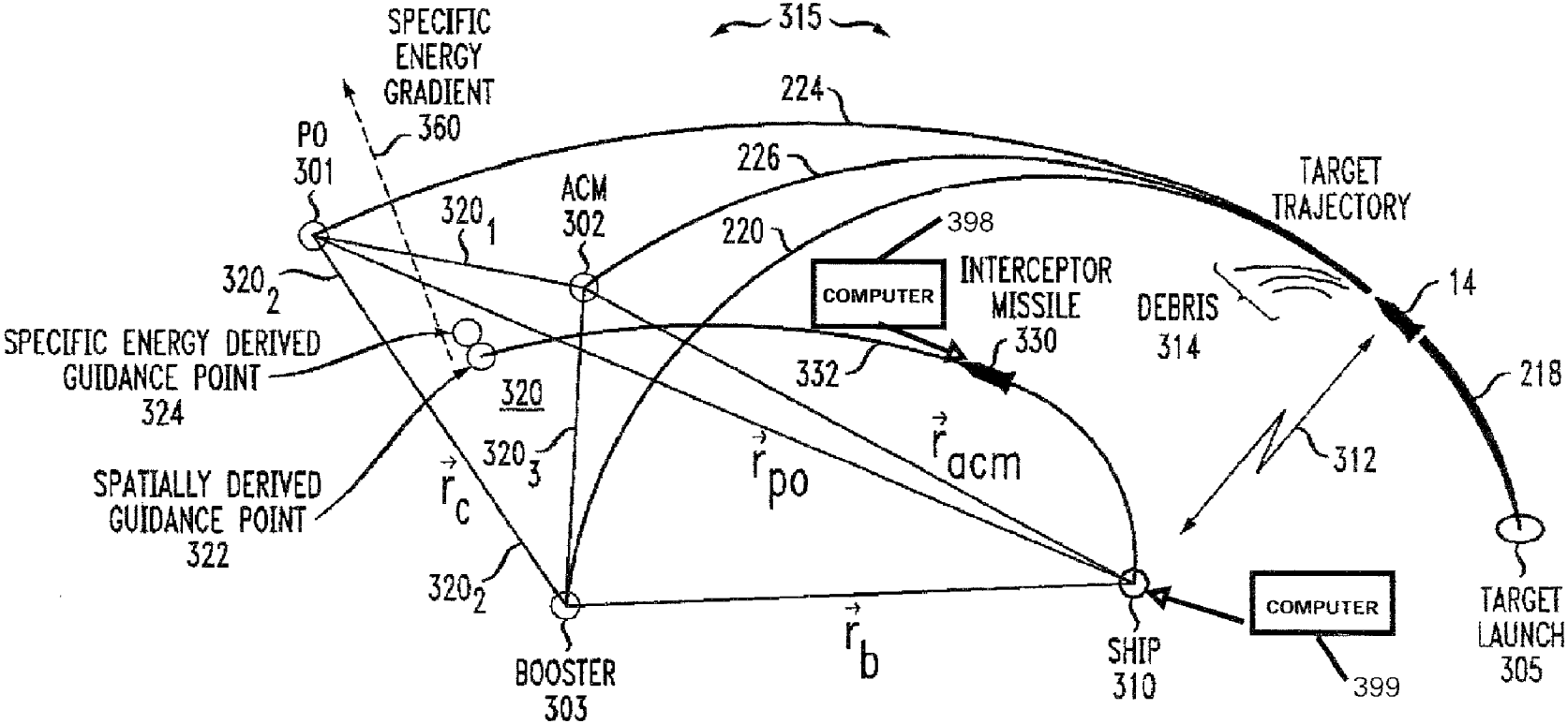
FIG. 3 illustrates additional aspects of the scenario of FIG. 2A, and in which the interceptor missile is guided toward the spatially derived guidance point of a triangle defined by the three principal separated components of the hostile missile, and which also illustrates a specific energy derived guidance point.

FIG. 3 is a representation of various geometrical relationships which are found in a scenario 300 in which a hostile missile 14 is launched from a location 305 and which conceals the identity of the preferred object with an attitude control module (acm) and spent booster (B), and in which the interceptor missile is guided toward a spatially derived guidance point 322. Elements of FIG. 3 corresponding to those of FIG. 2 are designated by like alphanumerics. FIG. 3 also illustrates a ship 310 which senses the missile 14 in the boost phase, as suggested by "lightning bolt" symbol 312. In FIG. 3, the hostile missile 14 boosts along path 218, and the boosting results in a cloud of debris designated 314. Ultimately, the booster takes a path 220, and at a given time arrives at a location illustrated by a booster circle 303. In the same manner, the acm follows a path 226 and arrives at the given time at a location illustrated as an acm circle 302. The group of objects including the preferred object po, the acm, and the booster, together with other debris 314, is designated 315. The preferred object po follows path 224 and at the given time arrives at a preferred object location illustrated as 301. Locations 301, 302, and 303 define the vertices or corners of a triangle designated generally as 320 and defined by sides $\mathbf{320}_1$, $\mathbf{320}_2$, and $\mathbf{320}_3$. Side $\mathbf{320}_1$ of the triangle 320 extends from the location 301 of preferred object po to the location 302 of attitude control module acm. Side $\mathbf{320}_2$ of triangle 320 extends from the preferred object location 301 to the location 303 of booster B, and side $\mathbf{320}_3$ extends from acm location 302 to the booster location 303. The range from the ship 310 to booster location 303 is designated $\vec{r}_b$, the range to acm location 302 is designated $\vec{r}_{acm}$, and the range to preferred object location 301 is designated $\vec{r}_{po}$.

An interceptor missile 330 of FIG. 3 launched as a counter to a hostile ballistic missile such as 14 must be guided, either remotely or locally, toward its target along a path such as path 332 until such time as the preferred object is identified from among the various decoy objects in the group. The guidance of the interceptor missile may often be remote until the autonomous seeker "locks onto" the preferred object object, which by that time is known. In the prior art, the interceptor missile was guided toward the spatially derived guidance point of the group of three principal objects until the preferred object was identified. A representative spatially derived guidance point location is designated 322 in FIG. 3. This method of guidance was not without faults, as, in order to effect an intercept of the preferred object, the interceptor missile would ordinarily have to be able to divert its path. In some cases, by the time the preferred object was identified from among the other objects, insufficient divert capability was available for intercepting the preferred object.

The spatially derived guidance point 322 of triangle 320 of FIG. 3 is designated $\vec{r}_c$ and given by $$\vec{r}_c = \frac{1}{N}\sum_{i=1}^{N} \vec{r}_i \tag{7}$$

where:

N represents the number of objects;

$\vec{r}$ a position vector of the $i^{th}$ object; and i is an index representing the $i^{th}$ object.

The specific energy of a ballistic object is designated as E and defined in equation (1). The specific energy of a group of N objects is defined by $$E = \sum_{i=1}^{N} E_i \tag{8}$$

and the specific energy derived guidance point is given by $$\vec{r}_E = \frac{1}{E}\sum_{i=1}^{N} \vec{r}_i E_i \tag{9}$$

A representative specific energy derived guidance point $\vec{r}_E$ is designated 324 in FIG. 3. The specific energy derived guidance point is closer to the location of the preferred object than the spatially derived guidance point. It has been found, however, that this difference in guidance point location is not a sensitive indicator of the actual preferred object location, and it was found that targeting the specific energy derived guidance point with the interceptor missile before final guidance gave little improvement.

FIG. 3 illustrates as an arrow 360 the specific energy gradient associated with triangle 320. It has been found that the gradient of the specific energy points generally in the direction of the preferred object. That being so, targeting the interceptor missile toward the spatially (or specific energy) derived guidance point modified by the gradient of the specific energy provides improved performance, in that the targeting point tends to be closer to the location of the preferred object than the unmodified spatially (or specific energy) derived guidance point 322 (or 324). Since the targeting point as modified by the gradient of the specific energy ends up closer to the actual location of the preferred object, there is a greater likelihood that the divert capability of the interceptor missile will be adequate to intercept the hostile missile.

Figure 4:
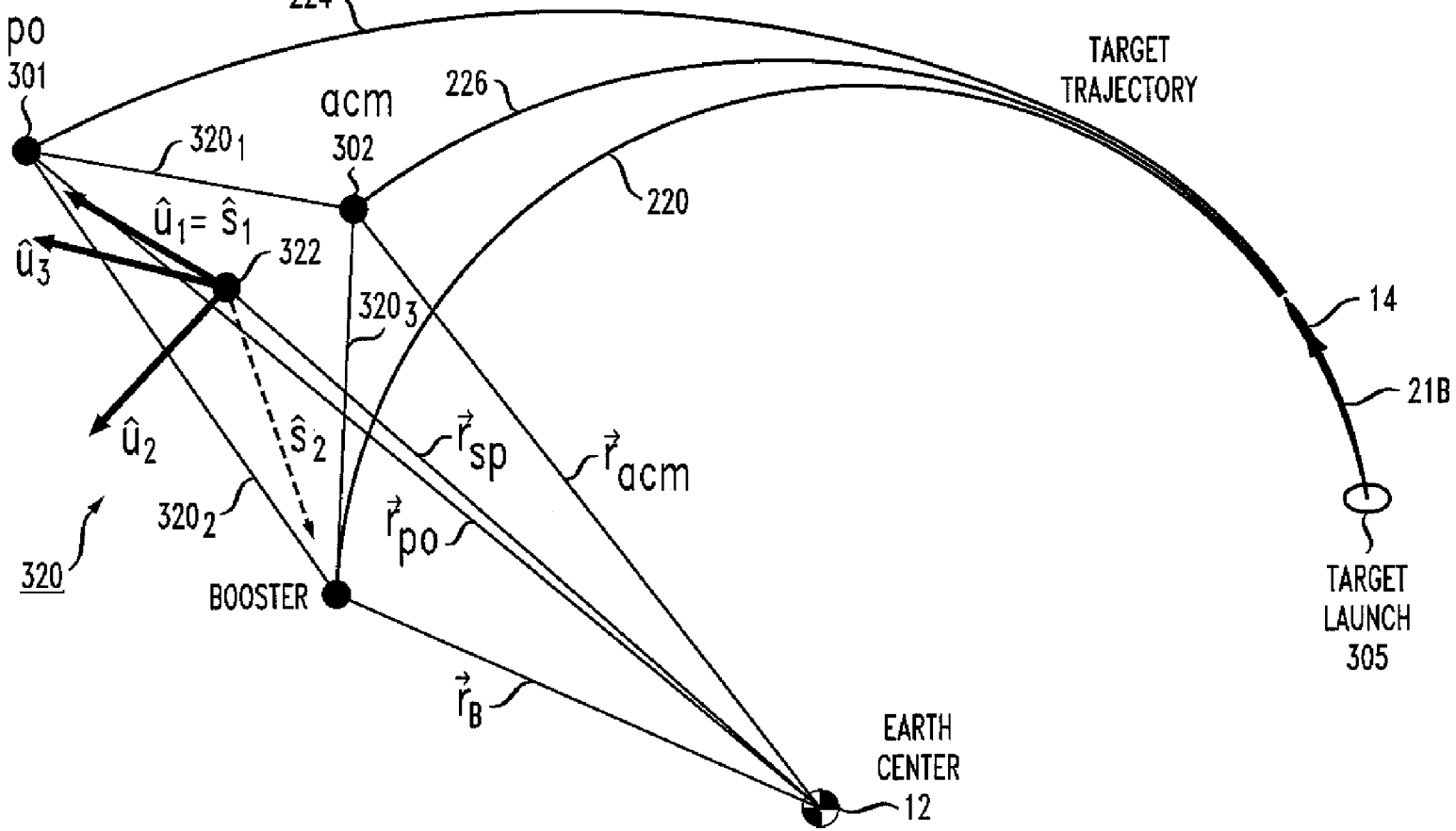
FIG. 4 illustrates a scenario similar to that of FIG. 3, with additional vectors explaining aspects of the invention.

FIG. 4 is generally similar to FIG. 3, but shows additional geometric information useful in understanding aspects of the invention. Elements of FIG. 4 corresponding to those of FIG. 3 are designated by like reference alphanumerics. In FIG. 4, the coordinate frame is based at the spatially derived guidance point 322. A vector extending between the Earth's center of gravity 12 and the location 301 of preferred object is designated $\vec{r}_{po}$, a vector extending from center 12 to the location 302 of attitude control module acm is designated $\vec{r}_{ACM}$, and a vector extending from center 12 to the location 303 of booster B is designated $\vec{r}_B$. A vector extending between the Earth's center 12 and the location of the spatially derived guidance point 322 is designated $\vec{r}_{sp}$ The three objects having specific energy above a threshold value (namely the preferred object, the acm, and booster B) are resolved into a coordinate frame defined by the plane containing the three objects, which plane is suggested by triangle 320 of FIG. 4. The coordinate frame is formed based on the position vectors of the three objects and the spatially derived guidance point 322, defined in the ECEF (Earth-Centered-Earth-Fixed) coordinate frame. Vector $\hat{s}_1$ is a unit vector (a vector with a magnitude of one) pointing from the spatially derived guidance point 322 toward one of the objects (illustrated as being the preferred object in the case of FIG. 4), where $\hat{s}_1$ is given by $$\hat{s}_1 = \frac{\vec{r}_{po} - \vec{r}_{sp}}{\|\vec{r}_{po} - \vec{r}_{sp}\|} \tag{10}$$

Vector $\hat{s}_2$ is a unit vector pointing from the spatially derived guidance point 322 to another object, illustrated as being the booster.

$$\hat{s}_2 = \frac{\vec{r}_b - \vec{r}_{sp}}{\|\vec{r}_b - \vec{r}_{sp}\|} \tag{11}$$

The basis vectors defining the coordinate frame are then formed as follows:

$$\hat{u}_1 = \hat{s}_1 \tag{12}$$

$$\hat{u}_3 = \frac{\hat{u}_1 \times \hat{s}_2}{\|\hat{u}_1 \times \hat{s}_2\|} \tag{13}$$

$$\hat{u}_2 = \frac{\hat{u}_3 \times \hat{u}_1}{\|\hat{u}_3 \times \hat{u}_1\|} \tag{14}$$

In FIG. 4, basis vectors $\hat{u}_1$ and $\hat{u}_2$ lie in the plane with the three principal objects (that is, in the plane including triangle 320), and basis vector $\hat{u}_3$ is normal to the plane.

Figure 5:
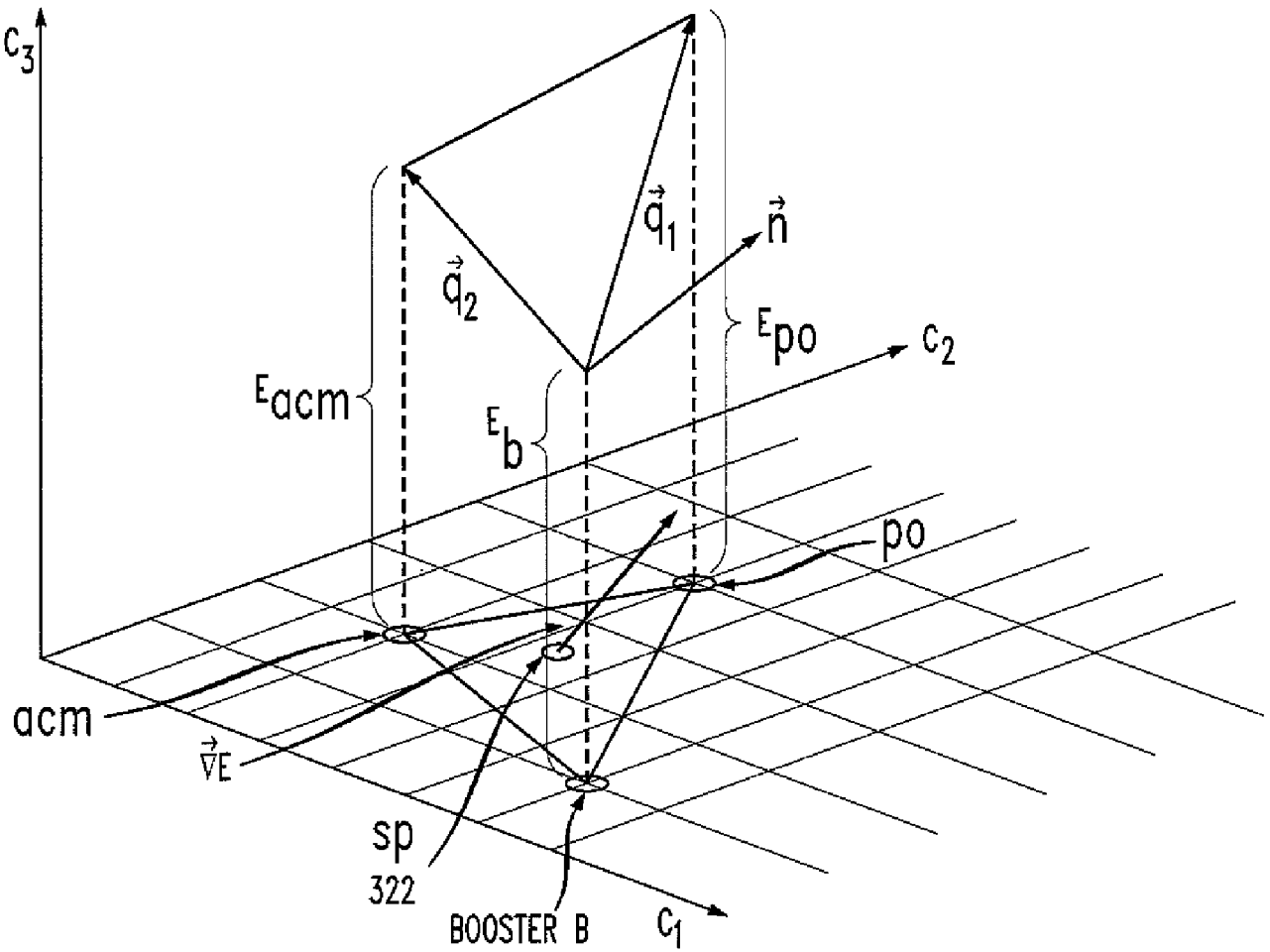
FIG. 5 represents a three-dimensional C coordinate frame or space defined by $C_1$, $C_2$, and $C_3$ dimensions, in which the preferred object, the attitude control module, and the booster lie in the $C_1$-$C_2$ plane, and further showing a specific energy space.

FIG. 5 illustrates a new C coordinate frame with mutually orthogonal axes or dimensions $C_1$, $C_2$, and $C_3$. The $C_1$ and $C_2$ axes may be viewed as representing position, and the $C_3$ axis may be viewed as representing specific energy. The three objects, namely the preferred object po, the attitude control module acm, and the booster B, lie in the $C_1$-$C_2$ plane. The spatially derived guidance point is designated sp. The rotation matrix $R_{ECEF}{}^{C}$ from the ECEF coordinate frame to the new coordinate frame C is:

$$R_{ECEF}{}^{C}[\hat{u}_1\hat{u}_2\hat{u}_3]^T \tag{15}$$

A vector representing each object can now be expressed in a specific energy space defined by the object's position vector in the C frame and the object's specific energy. The specific energy space is illustrated in FIG. 5 by the specific energy plane defined by vectors $\vec{q}_1$, $\vec{q}_2$, and the specific energy space defined by vector $\vec{n}$, normal or orthogonal to the specific energy plane. Vectors $\vec{q}_1$ and $\vec{q}_2$ connect the three objects in the specific energy plane, and vector $\vec{n}$ is normal or orthogonal to the specific energy plane. Vectors connecting the objects in specific energy space are defined as follows:

$$\vec{q}_1=\vec{x}_{po}^{\,C}-\vec{x}_b^{\,C} \tag{16}$$

$$\vec{q}_2=\vec{x}_{ACM}^{\,C}-\vec{x}_b^{\,C} \tag{17}$$

The specific energy plane is defined by a vector normal to that plane, calculated as:

$$\vec{n}=\vec{q}_1\times\vec{q}_2 \tag{18}$$

all of which are illustrated in FIG. 5.

Let vector $\vec{r}_i^{\,C}$ be the position vector of the $i^{th}$ object represented in the C coordinate frame. The vector of the $i^{th}$ object defined in specific energy space is formed by setting the third element of the position vector, $\vec{r}_i^{\,C}$, equal to the object's specific energy:

$$\vec{x}_i^C=\begin{bmatrix}\vec{r}_i^C(1)\\ \vec{r}_i^C(2)\\ E_i\end{bmatrix} \tag{19}$$

The specific energy plane can also be expressed in the form:

$$ax+by+cz+d=0 \tag{20}$$

Solving for z gives an expression for the specific energy at any point (x,y):

$$E(x,y)=z=\frac{-ax-by-d}{c} \tag{21}$$

The gradient at a point (x,y) gives the direction of the maximum spatial rate of increase of the specific energy. The gradient is calculated as:

$$\vec{\nabla}_E=\frac{\partial E(x,y)}{\partial x}\hat{i}+\frac{\partial E(x,y)}{\partial y}\hat{j} \tag{22}$$

A unit vector in the direction of the gradient is given by:

$$\hat{u}=\frac{\vec{\nabla}_E}{\|\vec{\nabla}_E\|} \tag{23}$$

where || || denotes the norm of the vector contained within. Evaluation of the specific energy gradient at the spatially derived guidance point gives the direction to shift the aimpoint.

Figure 6:
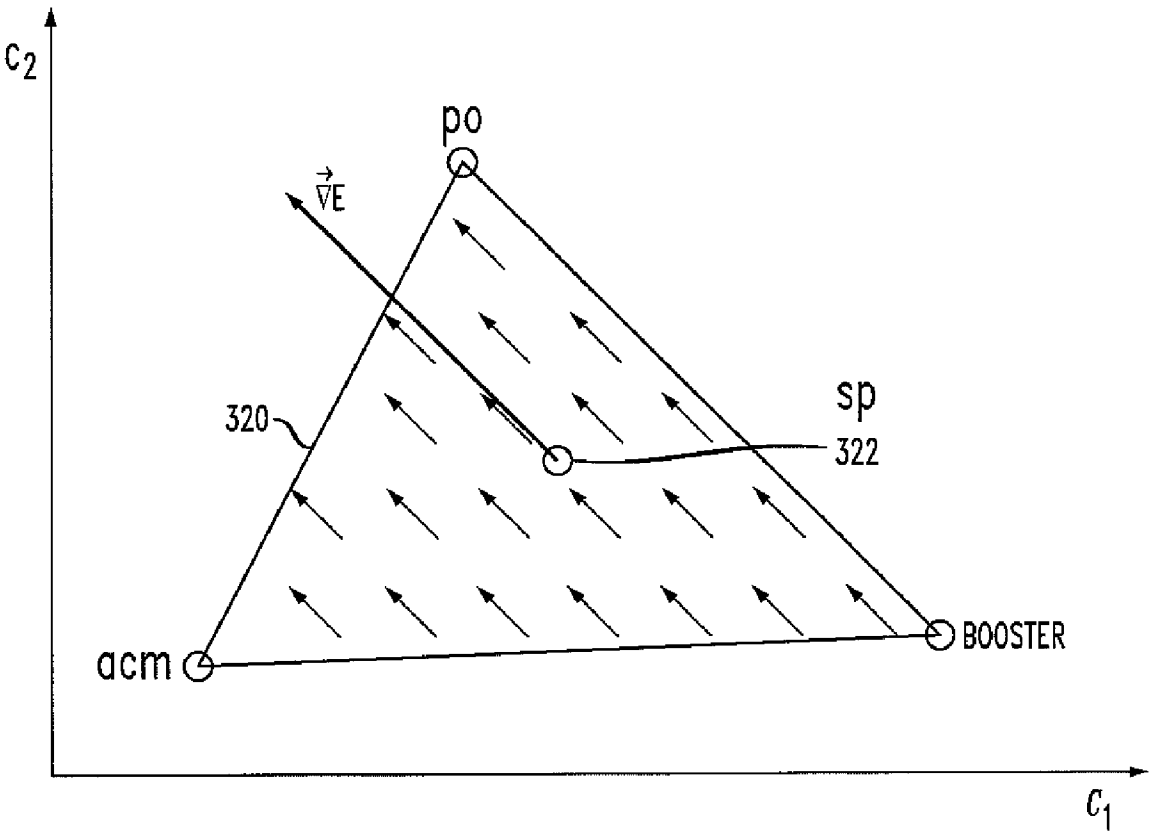
FIG. 6 illustrates a specific energy gradient about the spatially derived guidance point to aid in shifting the interceptor aim point.

In FIG. 6, the triangle 320 in the plane including the preferred object po, the attitude control module acm, and the booster illustrates the spatially derived guidance point 322 and a plurality of arrows indicating the specific energy gradient. A vector $\vec{\nabla}$E indicates the magnitude and direction of the specific energy gradient.

The aim point should be shifted from the spatially derived guidance point along the specific energy gradient so as to keep the objects most likely to be the preferred object within the divert capability of the missile.

Figure 7:
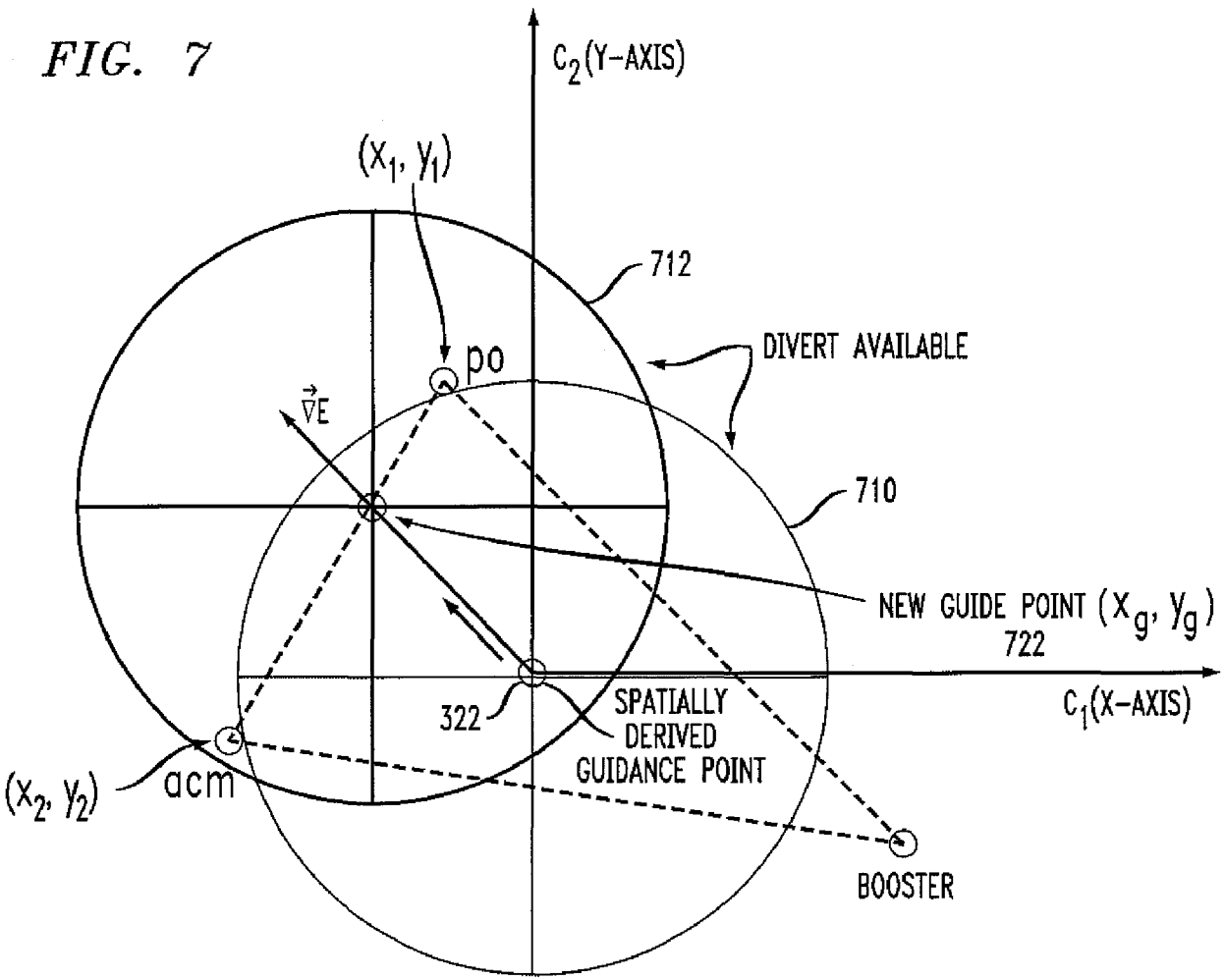
FIG. 7 illustrates geometry associated with FIG. 6 for aiding in determining the new aim or guide point prior to final guidance of the interceptor toward the target.

FIG. 7 is a simplified illustration of geometrical considerations which may be used to determine the shifted aim or new guide point 722 from the spatially derived guidance point and vector $\vec{\nabla}$E. In FIG. 7, a dotted-line circle 710 represents the divert capability of the interceptor missile centered on the spatially derived guidance point 322. In this hypothetical situation, it can be seen that the preferred object lies just outside of the divert limit circle 710. This means that, were the spatially derived guidance point 322 to be used as a guide point before acquisition of the preferred object and final guidance to the target, the interceptor could not "hit" the target. On the other hand, with the center of the divert circle 712 shifted to new guide point 722, the preferred object lies well within the bounds of the circle 712, meaning that there the interceptor missile is capable of reaching the target missile.

Figure 8:
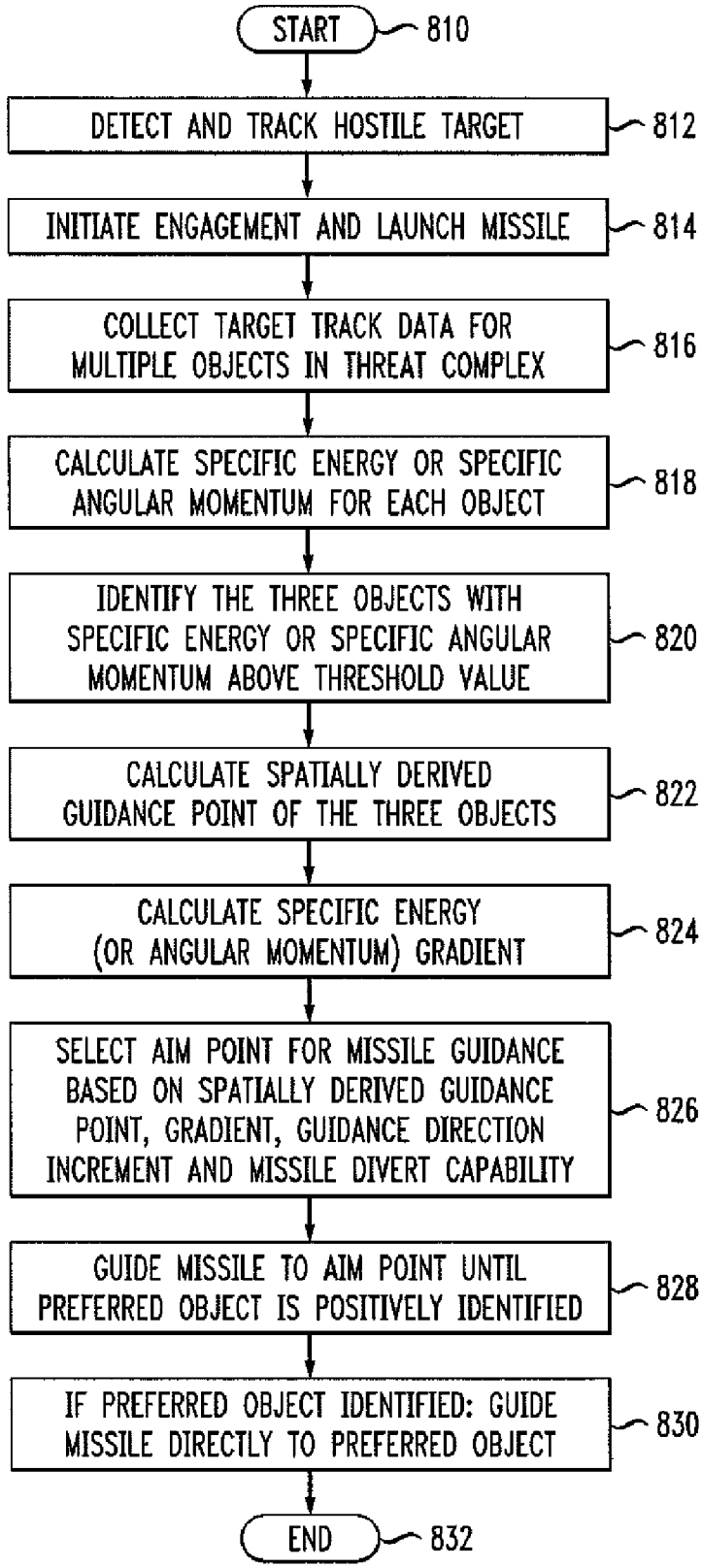
FIG. 8 is a simplified logic or control flow chart or diagram illustrating the method of the invention.

FIG. 8 is a simplified logic or control flow diagram or chart illustrating a method according to an aspect of the invention. In FIG. 8, the logic 800 begins at a START block 810, and flows to a block 812, which represents detection and tracking of a hostile target. From block 812, the logic flows to a block 814, representing the initiation of an engagement, which involves launching an intercepting missile. Upon threat separation (separation of the preferred object from the decoys), the logic flows to block 816, which represents collecting sensor information relating to the targets, such as target tracks of the various objects. From block 816, the logic 800 of FIG. 8 flows to a block 818, which represents calculation of the specific energy (or angular momentum) of each object in track, as described in conjunction with equations 1 and 2. From block 818, the logic 800 of FIG. 8 flows to a block 820, representing identification of the three most significant objects in the track, which are the three objects having specific energy above a threshold value. The identification is made using equations (1) or (2). From block 820, the logic flows to a block 822, which represents the calculation of the spatially derived guidance point, as detailed in conjunction with the description of equation 7. From block 822, the logic flows to block 824, which represents calculation of the specific energy gradient $\vec{\nabla}$E, described in conjunction with equations (22) and (23). From block 824, the logic flows to block 826, representing the selection of the aim or shifted guide point, which is performed as described in conjunction with FIGS. 6 and 7. The guide point is shifted from the spatially derived guidance point, in (parallel to) the direction of the specific energy gradient, until it intersects the line connecting the two objects of specific energy above another threshold value, taken in this case as being the dash line joining the preferred object with the acm. The point labeled "new guide point," will be the point toward which to guide the intercepting missile. This is illustrated in FIG. 7 and calculated in Equations 24 and 25:

$$x_g=\frac{-y_1x_2+x_1y_2}{-y_1+y_2+m(x_1-x_2)} \tag{24}$$

$$y_g=mx_g \tag{25}$$

Where, m is the slope of the specific energy gradient.

$$m=\frac{\nabla_{E(2)}}{\nabla_{E(1)}} \tag{26}$$

From block 826, the logic flows to a block 828, which represents guidance of the interceptor missile toward the shifted aim point. At some time, the preferred object will be identified by known means. The identity of the preferred object will be made known either to the interceptor missile, as by remote identification together with transmission to the interceptor of the identifying information, or by an autonomous seeker in the interceptor missile. At the time the preferred object is identified by or to the interceptor missile, control is transitioned away from guidance of the interceptor missile toward the shifted guide point and to guidance toward the preferred object, as suggested by block 830 of FIG. 8. The guidance toward the preferred object after the preferred object has been identified is well known in the art, and requires no further explanation. The logic 800 ends at an END block 832, and may occur when the interceptor missile hits the target, or may result from determination that a miss has occurred, in which case the warhead, if any, may be disarmed.

A method (800) according to an aspect of the invention is for targeting, with an interceptor (330), a preferred object from among a plurality of ballistic objects (preferred object, acm, booster, 314) in an associated group (315) of objects. The method comprises the step of sensing (312, 812, 816) a group (315) of potential target objects which includes a preferred object and an associated group of non-preferred objects (acm, B, 314), to thereby produce position and velocity vectors for each potential target object of the group. From the position and velocity vectors for each potential target object of the group, at least one of specific energy and specific angular momentum is computed (818) for each of the potential target objects, to thereby produce constants of orbital motion. From the constants of orbital motion, the three target objects having values of one of the specific energy and specific angular momentum above a threshold value are identified (820), to thereby identify a group of the three most likely target objects. The spatially derived guidance point (322) is calculated (822) of the group of three most likely target objects, using equation (7). The spatial rate of change or gradient ($\vec{\nabla}E$) of the constants of orbital motion is calculated (824), as described in conjunction with equations (22) and (23). A guidance direction increment ($x_g$,$y_g$) is generated (826), and the spatially derived guidance point (322) is combined (826) with the guidance direction increment ($x_g$,$y_g$) to thereby produce (826) a target or guide point (722) which is closer to the location of the preferred object than is the spatially derived guidance point (322). The thrust of the interceptor (330) is controlled to guide the interceptor vehicle toward the target or guide point (722). In a particular mode of the method, after the step (828) of controlling the thrust of the interceptor (330) toward the target or guide point (722), a determination is made of which of the potential target objects is the preferred object, and control of the interceptor (340) is transitioned (829) to guidance (830) toward the preferred object.

An engagement system (300) according to an aspect of the invention is for targeting and engaging a preferred object among a group of non-preferred objects (315). The system (300) comprises at least one sensor (312) for sensing a group of potential target objects (preferred object, acm, B, 315) which includes a preferred object and an associated group (314) of non-preferred objects, to thereby produce position and velocity vectors for each potential target object. The system (300) also comprises a computer arrangement (399), which may be a single computer or a distributed computer, and which may include modules for performing specific tasks or an integrated software entity for performing multiple specific tasks. The computer (399) includes at least an aspect for computing (818), from the position and velocity vectors, at least one of specific energy and specific angular momentum for each of the potential target objects, to thereby produce constants of orbital motion. A computer or ranking aspect thereof (820) ranks the constants of orbital motion for each of the potential target objects, and deems the three target objects having values (of the one of the specific energy and specific angular momentum) above a threshold as identifying a group of the three most likely target objects. A computer or spatially derived guidance point aspect (822) thereof calculates the spatially derived guidance point of the group of three most likely target objects, and calculates (824) the spatial rate of change of the constants of orbital motion, to thereby produce (826) a guidance direction increment. A computer or combining aspect (826) thereof combines the spatially derived guidance point with the guidance direction increment, to thereby produce an interceptor vehicle target point which is closer to the location of the preferred object than is the spatially derived guidance point. A controllable thrust controller (828) is coupled to receive the interceptor vehicle target point, and is also coupled to the interceptor vehicle, for controlling the thrust of the interceptor vehicle to guide the interceptor vehicle toward the target point.

The combining aspect of the method may include the identification of a particular line extending between the two objects having the values of the constant of orbital motion above a threshold, and identifies the interceptor vehicle target point as the intersection of the particular line with the projection of the spatially derived guidance point parallel with the guidance direction increment.

In a particularly advantageous aspect of the system (300), a computer (399) or identification aspect thereof is coupled for receiving at least the constants of orbital motion, for determining which of the potential target objects is the preferred object, and for generating a command for a transition (829) from guidance toward the target point to guidance toward the preferred object (830). A computer or aspect thereof (398) is coupled to the interceptor vehicle (330) and to receive the command for transition from guidance toward the target point to guidance toward the preferred object, and effectuates the transition from guidance toward the target point to guidance toward the preferred object.

What is claimed is:

1. A method for targeting a preferred object from among a plurality of ballistic objects in an associated group of objects, said method comprising the steps of:

sensing a group of potential target objects which includes a preferred object and an associated group of non-preferred objects to produce position and velocity vectors for each potential target object;

computing from said position and velocity vectors at least one of specific energy and specific angular momentum for each of said potential target objects, to produce constants of orbital motion;

from said constants of orbital motion, identifying three target objects having values of said one of said specific energy and specific angular momentum above a threshold, to identify a group of the three most likely target objects;

calculating a spatially derived guidance point of said group of three most likely target objects;

calculating a spatial rate of change of said constants of orbital motion, to produce a guidance direction increment;

combining said spatially derived guidance point with said guidance direction increment to produce a target point which is closer to a location of said preferred object than is said spatially derived guidance point; and controlling thrust of an interceptor vehicle to guide said interceptor vehicle toward said target point.

2. A method according to claim 1, wherein said step of computing from said position and velocity vectors at least one of specific energy and specific angular momentum for each of said potential target objects, to produce constants of orbital motion, includes the steps of, for each of said potential target objects, calculating one of (a) the specific energy E of the potential target object as $$E = \frac{V^2}{2} - \frac{\mu_e}{r}$$

where:

V is the velocity of the potential target object;

r is the radius to the center of the Earth; and $$\mu_e = 3.986 \times 10^{14} \frac{m^3}{s^2}$$

and (b) the specific angular momentum H as $$H = rV \cos \phi$$

where:

$\phi$ is the angle between the velocity vector and the local horizon.

3. A method according to claim 1, wherein said step of identifying three target objects having values of said one of said specific energy and specific angular momentum above a threshold value, to identify a group of the three most likely target objects, includes the step of:

ranking a value of said one of said specific energy and specific angular momentum for each of said potential target objects; and deeming those three objects having values above a threshold as being the group.

4. A method according to claim 1, wherein said step of calculating a spatially derived guidance point includes the step of calculating:

$$\vec{r}_e = \frac{1}{3}\sum_{i=1}^{3} \vec{r}_i$$

where:

the number of objects is three;

$\vec{r}_i$ is a position vector of the $i^{th}$ object; and i is an index representing the $i^{th}$ object.

5. A method according to claim 1, wherein said step of calculating a spatial rate of change of said constants of orbital motion, to produce a guidance direction increment includes the step of calculating the specific energy gradient as:

$$\vec{\nabla} E = \frac{\partial E(x, y)}{\partial x}\hat{i} + \frac{\partial E(x, y)}{\partial y}\hat{j}.$$

6. A method according to claim 1, wherein said step of combining said spatially derived guidance point with said guidance direction increment to produce a target point includes the steps of:

identifying a line extending between two of said three target objects having values of said one of said specific energy and specific angular momentum above a certain threshold; and identifying as said target point an intersection of said line and a projection of said spatially derived guidance point that is parallel with said direction increment.

7. A method according to claim 1, wherein said step of combining said spatially derived guidance point with said guidance direction increment to produce a target point includes the steps of:

shifting a guide point from the spatially derived guidance point in a direction parallel to a direction of the specific energy gradient; and continuing said shifting of the guide point from the spatially derived guidance point until the guide point intersects a line connecting the two objects having values of specific energy above a certain threshold.

8. A method according to claim 1, wherein said method includes the step, after said step of controlling the thrust of said interceptor vehicle toward said target point, of:

determining which of said potential target objects is the preferred object; and transitioning control of said interceptor vehicle to guidance toward said preferred object.

9. An engagement system for targeting and engaging a preferred object among a group of non-preferred objects, said system comprising:

at least one sensor for sensing a group of potential target objects which includes a preferred object and an associated group of non-preferred objects to produce position and velocity vectors for each potential target object;

a computer for computing from said position and velocity vectors at least one of specific energy and specific angular momentum for each of said potential target objects, to produce constants of orbital motion;

a computer for ranking the constants of orbital motion for each of the potential target objects, and for determining three target objects having values of said one of said specific energy and specific angular momentum above a threshold value as a group of the three most likely target objects;

a computer for calculating a spatially derived guidance point of said group of three most likely target objects;

a computer for calculating a spatial rate of change of said constants of orbital motion, to produce a guidance direction increment;

a computer for combining said spatially derived guidance point with said guidance direction increment, to produce an interceptor vehicle target point which is closer to a location of said preferred object than is said spatially derived guidance point; and a controllable thrust controller coupled to receive said interceptor vehicle target point, and coupled to said interceptor vehicle, for controlling thrust of said interceptor vehicle to guide said interceptor vehicle toward said interceptor vehicle target point.

10. A system according to claim 9, further comprising:

a computer coupled for receiving at least said constants of orbital motion, for determining which of said potential target objects is the preferred object, and for commanding a transition from guidance toward said interceptor vehicle target point to guidance toward said preferred object; and a computer coupled to said interceptor vehicle for receiving said command for transition from guidance toward said target point to guidance toward said preferred object, and for effectuating said transition from guidance toward said target point to guidance toward said preferred object.

11. A system for targeting a preferred object from among a plurality of ballistic objects in an associated group of objects, said system comprising:

a processor executing instructions for performing the steps of:

sensing a group of potential target objects which includes a preferred object and an associated group of non-preferred objects to produce position and velocity vectors for each potential target object;

computing from said position and velocity vectors at least one of specific energy and specific angular momentum for each of said potential target objects, to produce constants of orbital motion;

from said constants of orbital motion, identifying a plurality of target objects having values of said one of said specific energy and specific angular momentum above a threshold, to identify a group of the most likely target objects;

calculating a spatially derived guidance point of said group;

calculating a spatial rate of change of said constants of orbital motion, to produce a guidance direction increment;

combining said spatially derived guidance point with said guidance direction increment to produce a target point which is closer to a location of said preferred object than is said spatially derived guidance point; and controlling thrust of an interceptor vehicle to guide said interceptor vehicle toward said target point.

12. A system according to claim 11, wherein said step of computing from said position and velocity vectors at least one of specific energy and specific angular momentum for each of said potential target objects, to produce constants of orbital motion, includes the steps of, for each of said potential target objects, calculating one of: (a) the specific energy of the potential target object, and (b) the specific angular momentum of the potential target object.

13. A system according to claim 11, wherein said step of identifying three target objects having values of said one of said specific energy and specific angular momentum above a threshold value, to identify a group of the most likely target objects, includes the steps of:

ranking a value of said one of said specific energy and specific angular momentum for each of said potential target objects; and deeming those objects having values above a threshold as being the group.

14. A system according to claim 11, wherein said step of calculating a spatial rate of change of said constants of orbital motion, to produce a guidance direction increment includes the step of calculating a specific energy gradient.

15. A system according to claim 11, wherein said step of combining said spatially derived guidance point with said guidance direction increment to produce a target point includes the steps of:

identifying a line extending between two objects of said group having values of said one of said specific energy and specific angular momentum above a certain threshold; and identifying as said target point an intersection of said line and a projection of said spatially derived guidance point that is parallel with said direction increment.

16. A system according to claim 11, wherein said step of combining said spatially derived guidance point with said guidance direction increment to produce a target point includes the steps of:

shifting a guide point from the spatially derived guidance point in a direction parallel to a direction of the specific energy gradient; and continuing said shifting of the guide point from the spatially derived guidance point until the guide point intersects a line connecting the two objects having values of specific energy above a certain threshold.

17. A system according to claim 11, wherein said processor executes instructions for performing the additional steps, after said step of controlling the thrust of said interceptor vehicle toward said target point, of:

determining which of said potential target objects is the preferred object; and transitioning control of said interceptor vehicle to guidance toward said preferred object.

* * * * *